US005638794A

United States Patent [19]

Kubo et al.

[11] Patent Number: 5,638,794

[45] Date of Patent: Jun. 17, 1997

[54] SERVO VALVE TYPE TIMER FOR FUEL INJECTION PUMP

[75] Inventors: Ken-ichi Kubo; Jun Matsubara, both of Higashimatsuyama, Japan

[73] Assignee: Zexel Corporation, Tokyo, Japan

[21] Appl. No.: 492,164

[22] Filed: Jun. 19, 1995

[30] Foreign Application Priority Data

Jun. 24, 1994 [JP] Japan ..... 6-165976

[51] Int. Cl.[6] ..... F02M 37/04; F02D 1/18

[52] U.S. Cl. ..... 123/502

[58] Field of Search ..... 123/500, 501, 123/502

[56] References Cited

U.S. PATENT DOCUMENTS

| | | | |
|---|---|---|---|
| 4,534,332 | 8/1985 | Eheim et al. | 123/502 |
| 4,590,913 | 5/1986 | Faupel et al. | 123/502 |
| 4,593,669 | 6/1986 | Igarashi | 123/502 |
| 4,638,782 | 1/1987 | Yasuhara et al. | 123/502 |
| 4,753,211 | 6/1988 | Hofer | 123/502 |
| 5,263,457 | 11/1993 | Konrath et al. | 123/502 |
| 5,413,079 | 5/1995 | Laufer | 123/502 |
| 5,413,080 | 5/1995 | Laufer | 123/502 |

FOREIGN PATENT DOCUMENTS

| | | |
|---|---|---|
| 0487087 | 5/1992 | European Pat. Off. . |
| 3928219 | 3/1990 | Germany . |
| 3275948 | 12/1991 | Japan . |

*Primary Examiner*—Thomas N. Moulis
*Attorney, Agent, or Firm*—Darby & Darby

[57] ABSTRACT

A servo valve type timer for controlling a fuel injection timing on the basis of the difference in pressure between a high-pressure chamber and a low-pressure chamber, including a timer piston for adjustment of a fuel injection timing which is disposed between the high-pressure chamber and the low-pressure chamber so as to be slidable between the high-pressure chamber and the low-pressure chamber and is operated in accordance with a fuel pressure introduced into the high-pressure chamber and/or the low-pressure chamber, a servo valve for controlling the operation of the timer piston, and a pressure control member for adjusting the fuel pressure of the low-pressure chamber.

4 Claims, 3 Drawing Sheets

SERVO VALVE TYPE TIMER FOR FUEL INJECTION PUMP

BACKGROUND OF THE INVENTION

1. Field of the Invention

The present invention relates to a servo valve type timer for a fuel injection pump, and particularly to a servo valve type timer having a timer piston for adjusting a fuel injection timing, the timer piston being equipped with a servo valve.

2. Description of Related Art

There has been hitherto known a servo valve type timer for a fuel injection pump (as disclosed in Japanese Laid-open Patent Application No. Hei-3-275948). This servo valve type timer includes a timer cylinder, a timer spring which is provided in a low-pressure chamber of the timer cylinder, a timer piston which is urged by the timer spring, and a servo valve which is disposed at the low-pressure chamber side of the timer piston and is urged by a servo valve spring provided in the low-pressure chamber. In this servo valve type timer, by pushing down the timer piston, a fuel injection timing is adjusted in accordance with the pressure of a pump chamber, which is introduced into a high-pressure chamber of the timer cylinder.

In this type of timer, the servo valve is designed so that one pressure receiving face thereof is disposed to face the low-pressure chamber and the other pressure receiving face thereof is disposed to face the pump chamber. Hitherto, it has been a general way for adjustment of the fuel injection timing that the servo valve is first shifted to a spark advance side (in a spark advance direction) or a spark delay side (in a spark delay direction), and then the timer piston is shifted to the spark advance side or the delay side by controlling the fuel pressure around the pressure receiving face of the servo valve which faces the pump chamber.

However, it is difficult to greatly vary the pressure in the pump chamber because the pump chamber is designed in large volume. Therefore, in the conventional system of controlling the pressure of the pump chamber side, it is impossible to greatly vary the fuel pressure around the pressure receiving face of the servo valve, and thus a controllable range of the fuel injection timing is limited to a small range.

SUMMARY OF THE INVENTION

An object of the present invention is to provide a servo valve type timer which is capable of controlling the fuel injection timing in a broad range.

In order to attain the above object, according to a first aspect of the present invention, a servo valve type timer includes a timer piston for adjustment of a fuel injection timing which is operated in accordance with a fuel pressure introduced into a high-pressure chamber and/or a low-pressure chamber, a servo valve for controlling the operation of the timer piston, and pressure control means for adjusting the fuel pressure of the low-pressure chamber.

In the servo valve type timer as described above the pressure control member comprises an electromagnetic valve which is linked to at least the low-pressure chamber to control the pressure of the low-pressure chamber by switching on and/or off fuel flow between the electromagnetic valve and the low-pressure chamber, thereby adjusting the fuel pressure of the low-pressure chamber.

According to a second aspect of the present invention, a servo valve type timer includes a timer piston for adjustment of a fuel injection timing which is operated in accordance with a fuel pressure introduced into a high-pressure chamber and/or a low-pressure chamber, a servo valve for controlling the operation of the timer piston, and an electromagnetic valve which is disposed between a pump chamber and the low-pressure chamber and serves to adjust the fuel pressure of the low-pressure chamber.

According to a third aspect of the present invention, a servo valve type timer includes a servo valve type timer includes a timer piston for adjustment of a fuel injection timing which is operated in accordance with a fuel pressure introduced into a high-pressure chamber and/or a low-pressure chamber, a servo valve for controlling the operation of the timer piston, and an electromagnetic valve which is disposed between the low-pressure chamber and a low-pressure port and serves to adjust the fuel pressure of the low-pressure chamber.

According to the first aspect of the present invention, in order to control the fuel injection timing in a spark advance direction, the fuel pressure of the low-pressure chamber is first reduced by the pressure control means. Upon this operation, a valve plug of the servo valve is shifted to the spark advance side. This shift of the valve plug allows fuel to flow into a high-pressure chamber, so that the timer piston is shifted to the spark advance side by fuel pressure thus produce, whereby the fuel injection timing is advanced. On the other hand, in order to delay the fuel injection timing in accordance with reduction in engine rotational number from the spark-advanced state, the fuel pressure of the low-pressure chamber is increased by the pressure control means, and the increase of the fuel pressure causes the timer piston to shift to a spark delay side, whereby the fuel injection timing is delayed.

According to the second aspect of the present invention, if the opening degree of the electromagnetic valve is controlled to be closed, the fuel pressure of the low-pressure chamber is reduced, so that the fuel injection timing is advanced. On the other hand, if the opening degree of the electromagnetic valve is controlled to be opened, the fuel in the pump chamber flows into the low-pressure chamber to increase the fuel pressure, so that the fuel injection timing is delayed.

According to the third aspect of the present invention, if the opening degree of the electromagnetic valve is controlled to be opened, the fuel in the low-pressure chamber flows out and thus the fuel pressure of the low-pressure chamber is reduced, so that the fuel injection timing is advanced. On the other hand, if the opening degree of the electromagnetic valve is controlled to be closed, the flow-out of the fuel from the low-pressure chamber is ceased, and thus the fuel pressure in the low-pressure chamber is increased, so that the fuel injection timing is delayed.

DETAILED DESCRIPTION OF THE PREFERRED EMBODIMENTS

Preferred embodiments according to the present invention will be described hereunder with reference to the accompanying drawings.

Figure 1:
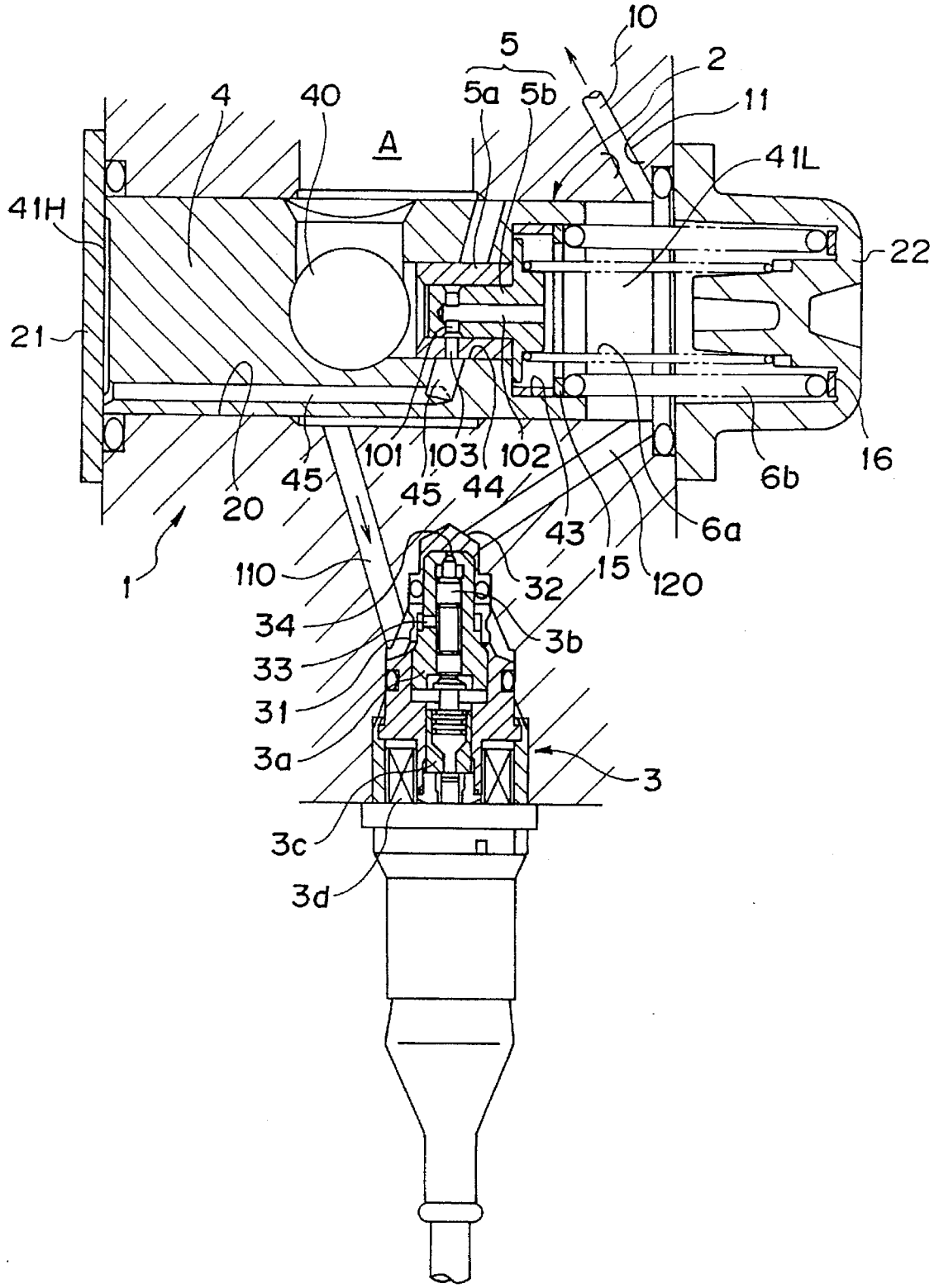
FIG. 1 is a cross-sectional view showing an embodiment of a servo valve type timer for a fuel injection pump according to the present invention.

FIG. 1 shows a servo valve type timer in an initialized state where a spark advance is set to zero.

In FIG. 1, reference numeral 1 represents a housing of a distribution type fuel injection pump, reference numeral 2 represents a servo valve timer unit which is provided in the housing 1, and reference numeral 3 represents an electromagnetic valve (duty solenoid valve) which is inserted in and mounted on a housing portion at the lower side of the servo valve timer unit 2.

The servo valve timer unit 2 has a cylinder hole 20 which is perpendicular to a drive shaft, and the cylinder hole 20 is oiltightly closed at both ends thereof by a high-pressure side cover 21 and a low-pressure side cover 22. In the cylinder hole 20 are disposed a timer piston 4 which is slidable along an axial direction of the cylinder hole 20, a servo valve 5 for controlling the slidable motion of the timer piston 4, and springs 6*a* and 6*b*.

A recess portion 40 is formed at the middle portion of the timer piston 4 in the axial direction thereof so that the outer peripheral portion thereof is opened to a pump chamber A. Furthermore, a slider (not shown) having a short cylindrical section is engagedly inserted in the recess portion 40, and the slider is engagedly secured to the tip of a link pin (not shown) which is linked to a roller holder (not shown).

A high-pressure chamber 41H is formed between the timer piston 4 and the high-pressure side cover 21, and a low-pressure chamber 41L is formed between the timer piston 4 and the lower-pressure side cover 22. A low-pressure port 10 is formed in the housing 1 so as to intercommunicate with the low-pressure chamber 41L, and the low-pressure port 10 is provided with an orifice 11.

A stepped cavity comprising a small-diameter hole 44 and a large-diameter hole 43 is penetratingly formed in the timer piston 4 so as to extend from the lower-pressure chamber side to the recess portion 40, and a passage 45 is also formed in the timer piston 4 so that it intersects to the small-diameter hole 44 and then is bent so as to intercommunicate with the high-pressure chamber 41H. A snap ring 15 is secured onto the wall of the large-diameter hole 43 of the timer piston 4, and a spring 6*b* is interposed between the snap ring 15 and a sheet 16 which is mounted on the inner wall of the low-pressure side cover 22. The spring 6*b* does not work as an element for performing a timer characteristic like a spring in a normal timer, but it works as an element for preventing vibration of the timer piston 4.

The servo valve 5 includes a valve body 5*a* which is pressed in the small-diameter hole 44, and a valve plug 5*b* which is engagedly inserted in the valve body 5*a* so as to be slidable in the small-diameter hole 44. The valve plug 5*b* is urged toward the high-pressure side by a spring 6*a* which is disposed in the low-pressure chamber 41L. Furthermore, a passage 103 which extends to the passage 45 is formed in the valve body 5*a*, and passages 101 and 102 which extend to the passage 103 are formed in the valve plug 5*b*.

According to this embodiment, the main feature thereof resides in a mechanical structure for moving the servo valve 5. That is, in this embodiment an electromagnetic valve (pressure control means) 3 for adjusting the fuel pressure of the low-pressure chamber 41L is provided to control the movement of the timer piston 4, and in this sense the electromagnetic valve is also called as "timing control valve".

The electromagnetic valve 3 is embedded in a blind hole of the housing 1, and it has a valve plug 3*a*, a needle 3*b* which can close a tip hole 34 of the valve plug 3*a*, an armature 3*c* which is fixed to a rear portion of the needle, and an electromagnetic portion 3*d* which is supplied with current to electromagnetically attract the armature 3*c* to thereby move the armature 3*c* in the axial direction of the electromagnetic valve 3.

The electromagnetic portion 3*d* is connected to an external electronic controller (not shown), and the electronic controller conducts processing and operation on signals output from various sensors and supplies the electromagnetic portion 3*d* with a duty ratio (rate of a valve opening time within unit time) of a driving signal corresponding to the processing result.

A high-pressure side chamber 31 is formed at a blind hole portion on the outer peripheral portion in the middle of the valve plug 3*a*, and the high-pressure side chamber 31 intercommunicates with the pump chamber A through a passage 110. A side hole 33 is formed in the valve plug 3*a*, and fuel oil is introduced from the pump chamber A through the side hole 33 into the needle 3*b*. Furthermore, a low-pressure side chamber 32 is also provided between the valve plug 3*a* and the bottom of the blind hole, and it intercommunicates with the low-pressure chamber 41L through a passage 120.

Next, an operation of the servo valve type timer thus constructed will be described.

It is well known that the recess portion 40 of the timer piston 4 intercommunicates with the pump chamber A and the pump chamber A is kept under the pressure corresponding to the rotational number of an engine.

In order to control the fuel injection timing in the spark advance direction, the opening degree of the electromagnetic valve 3 is first controlled to be small (i.e. the electromagnetic valve 3 is controlled in a closing direction). Upon the closing operation of the electromagnetic valve 3, a fuel supply operation from the pump chamber A through the electromagnetic valve 3 to the low-pressure chamber 41L is interrupted, so that the pressure of the low-pressure chamber 41L is reduced by an amount corresponding to a fuel amount which leaks from the low-pressure chamber 41L through the orifice 11 to the low-pressure port 10. Through this operation, the pressure balance at right and left sides of the valve plug 5*b* of the servo valve 5 is collapsed as represented by the following equation (1), and thus the valve plug 5*b* is shifted to a right side of FIG. 1 (i.e., to a spark advance side):

$$\text{spring force of spring } 6a < S \times Pt - S \times Pb \quad (1)$$

S: area of valve plug 5*b*

Pt: pump chamber pressure

Pb: pressure of low-pressure chamber 41L

When the valve plug 5*b* is shifted to the right side of FIG. 1 and thus the left end of the valve plug 5*b* is deviated from the left end of the passage 103, the fuel in the pump chamber A flows into the high-pressure chamber 41H through the recess portion 40, the passage 103 and the passage 45, and thus the timer piston 4 is shifted to the right side of FIG. 1 by the fuel pressure. With this operation, the roller holder (not shown) is rotated through the link pin (not shown), so that the fuel injection timing is advanced.

On the other hand, in order to delay the fuel injection timing from the above spark-advanced state in accordance with reduction in the rotational number of the engine or the like, the opening degree of the electromagnetic valve 3 is controlled to be large (i.e., the electromagnetic valve 3 is controlled in an opening direction). With this operation, the fuel in the pump chamber A flows into the low-pressure chamber 41L through the passage 110, the electromagnetic valve 3 and the passage 120, so that the pressure of the low-pressure chamber 41L increases.

Through this operation, the pressure balance at the right and left sides of the valve plug 5b of the servo valve is collapsed as represented by the following equation (2), and the valve plug 5b is shifted to the left side of FIG. 1 (to a spark delay side):

$$\text{spring force of spring } 6a > S \times Pt - S \times Pb \quad (2)$$

When the valve plug 5b is shifted to the left side of FIG. 1 and the passages 45 and the passages 101 to 103 intercommunicate with one another, the fuel in the high-pressure chamber 41H flows into the low-pressure chamber 41L, so that the pressure of the low-pressure chamber 41L increases. With this operation, the timer piston 4 is shifted to the left side of FIG. 1 by the pump driving reaction force and the spring force of the external spring 6b. Accordingly, the roller holder (not shown) is reversely rotated through the link pin (not shown), and thus the fuel injection timing is delayed.

In short, according to this embodiment, one pressure receiving face of the valve plug 5b of the servo valve 5 is disposed to face the low-pressure chamber 41L, and the other pressure receiving face is disposed to face the pump chamber A. In addition, by controlling the pressure of the low-pressure chamber 41L which faces the one pressure receiving face of the valve plug 5b, the movement of the servo valve 5 is controlled and thus the movement of the timer piston 4 is controlled.

In general, the low-pressure chamber 41L is remarkably smaller in volume than the pump chamber A. It has been adopted in the prior art to control the pressure of the pump chamber A which is larger in volume, so that the prior art cannot greatly vary the pressure acting on the pressure receiving face of the servo valve 5. On the other hand, according to this embodiment, the pressure of the low-pressure chamber 41L which is smaller in volume is controlled, so that the control pressure can be greatly varied. Accordingly, this embodiment can broaden the controllable range of the fuel injection timing.

Figure 2:
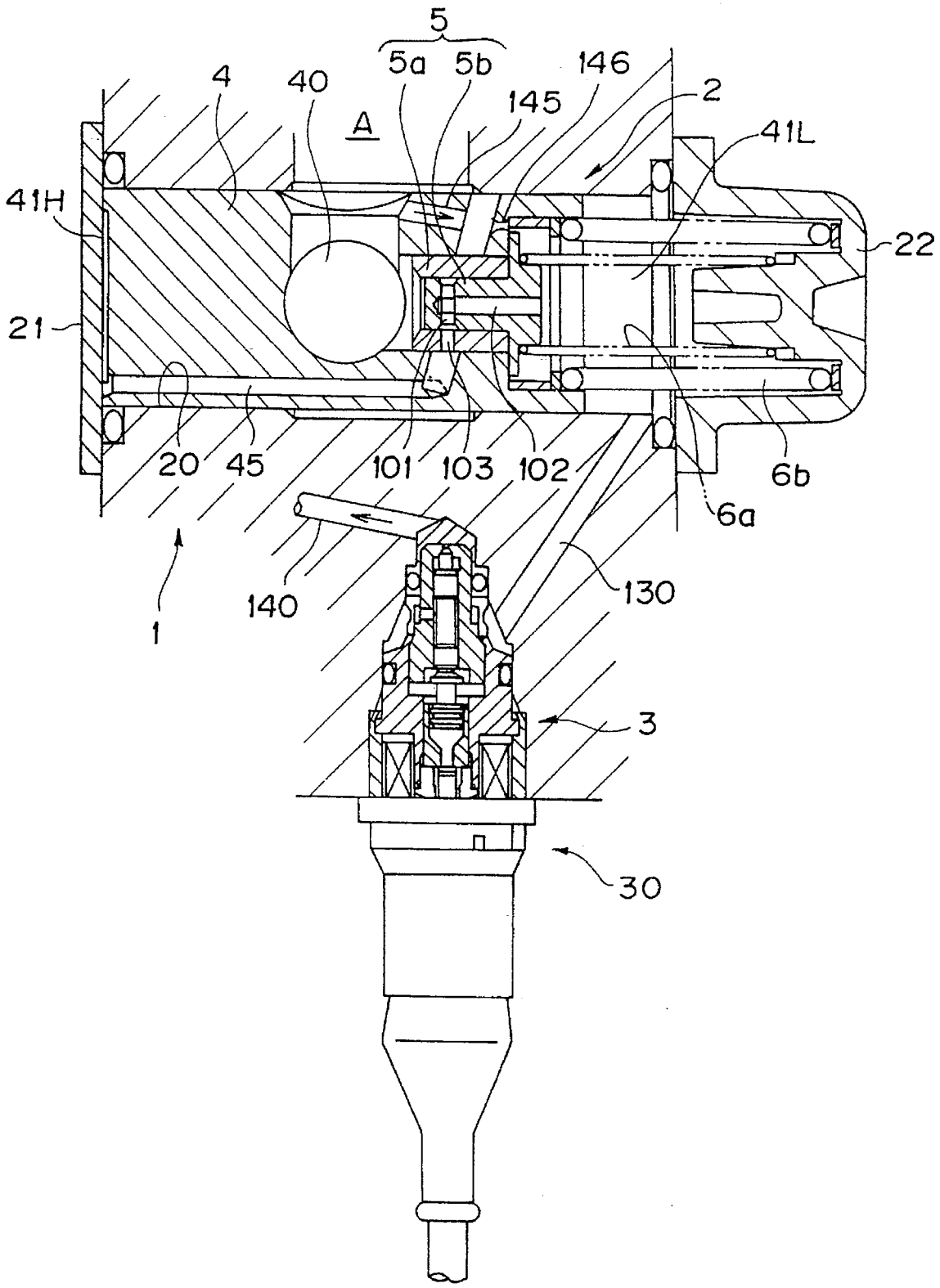
FIG. 2 is a cross-sectional view showing a second embodiment of the servo valve type timer according to the present invention.

FIG. 2 shows a second embodiment of the servo valve type timer according to the present invention.

The servo valve type of timer of this embodiment is provided with an electromagnetic valve 30 which intercommunicates with a low-pressure chamber 41L through a passage 130 and also intercommunicates with a low-pressure port of the housing 1 through a passage 140. Furthermore, the low-pressure chamber 41L intercommunicates with the pump chamber A through a passage 145 which is provided in the timer piston, and the passage 145 is provided with an orifice 146. The other construction of this embodiment is substantially identical to that of the first embodiment shown in FIG. 1.

Next, an operation of this embodiment will be described.

In order to control the fuel injection timing in the spark advance direction, the opening degree of the electromagnetic valve 3 is first controlled to be large (in the opening direction) (i.e., the control is opposite to that of FIG. 1). With this opening control operation, the fuel in the low-pressure chamber 41L leaks through the passage 130, the electromagnetic valve 30 and the passage 140 to the low-pressure port of the housing 1, and thus the pressure balance at the right and left sides of the valve plug 5b of the servo valve 5 is collapsed as represented by the equation (1). Therefore, the valve plug 5b is shifted to the right side of FIG. 2 (to the spark advance side).

When the valve plug 5b is shifted to the right side and thus the left end of the valve plug 5b is deviated from the left end of the passage 103, the fuel in the pump chamber A flows into the high-pressure chamber 41H through the passage 45, and the timer piston 4 is shifted to the right side of FIG. 2 by the fuel pressure, so that the roller holder (not shown) is rotated through the link pin (not shown) and the fuel injection timing is advanced.

On the other hand, in order to delay the fuel injection timing from the above spark advanced state in accordance with reduction of the rotational number of the engine or the like, the opening degree of the electromagnetic valve 3 is controlled to be small (in the closing direction). With this operation, the flow-out of the fuel from the low-pressure chamber 41L is suppressed, and the pressure of the low-pressure chamber 41L rises up by an amount corresponding to the fuel amount which flows from the pump chamber A through the passage 145 and the orifice 146 into the low-pressure chamber 41L. Therefore, the pressure balance at the right and left sides of the valve plug 5b of the servo valve 5 is collapsed as represented by the equation (2), and the valve plug 5b is shifted to the left side of FIG. 2 (to spark delay side).

When the valve 5b is shifted to the left side of FIG. 2 and the passage 45 and the passages 101 to 103 intercommunicate with one another, the fuel in the high-pressure chamber 41H flows into the low-pressure chamber 41L, and the pressure of the low-pressure chamber 41L rises up. Therefore, the timer piston is shifted to the left side of FIG. 2 by the reaction force of the pump cam side and the spring force of the external side spring 6b, so that the roller holder (not shown) is reversely rotated through the link pin (not shown) and the fuel injection timing is delayed.

Figure 3:
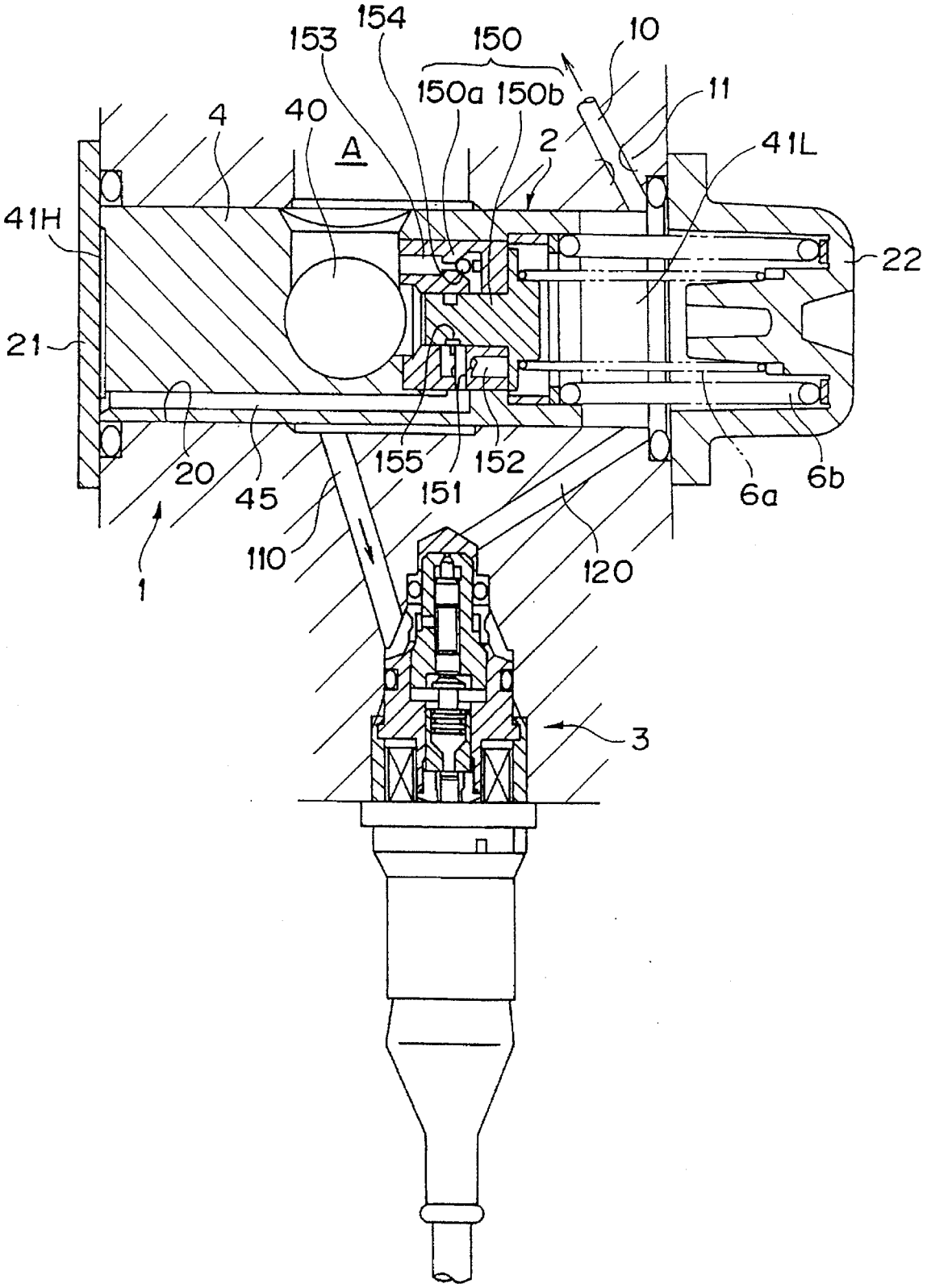
FIG. 3 is a cross-sectional view showing a third embodiment of the servo valve type timer according to the present invention.

FIG. 3 shows a third embodiment of the servo valve type timer according to the present invention.

In this embodiment, the linkage of the electromagnetic valve 3 is the same as the first embodiment shown in FIG. 1, and this embodiment is characterized by the structure of the servo valve 150. That is, the servo valve 150 of this embodiment is provided with a check valve 154 therein.

A servo valve 150 of this embodiment includes a valve body 150a which is pressed in the small-diameter hole 44, and a valve plug 150b which is engagedly inserted in the valve body 150a so as to be slidable in the valve body 150a. The valve plug 150b is urged toward the high-pressure side by the spring 6a disposed in the low-pressure chamber 41L.

The valve body 150a is provided with a passage 151 which intercommunicates with the passage 45, a passage 152 which intercommunicates with the low-pressure chamber 41L and a passage 153 which intercommunicates with the pump chamber A, and a check valve 154 is provided in the passage 153. Furthermore, the valve plug 150b is provided with a groove 155 which extends in the peripheral direction thereof.

Next, an operation of the servo valve type time of the third embodiment will be described hereunder.

In order to control the fuel injection timing in the spark advance direction, the opening degree of the electromagnetic valve 3 is first controlled to be small (in the closing direction). With the closing control operation of the opening degree of the electromagnetic valve 3, the fuel supply from the pump A to the low-pressure chamber 41L is interrupted, so that the pressure of the low-pressure chamber 41L is reduced by an amount corresponding to the fuel amount which leaks through the orifice 11 to the low-pressure port 10. Therefore, the pressure balance at the right and left sides of the valve plug 150b of the servo valve 150 is collapsed as represented by the equation (1), and the valve plug 150b is shifted to the right side of FIG. 3 (to the spark advance side).

When the valve plug 150*b* of the servo valve 150 is shifted to the right side of FIG. 3 and the passages 151 and 153 intercommunicate with each other through the groove 155, the fuel in the pump chamber A flows through the passage 45 into the high-pressure chamber 41H, and thus the timer piston 4 is pushed to the right side of FIG. 3 by the fuel pressure. With this operation, the roller holder (not shown) is rotated through the link pin (not shown), and the fuel injection timing is advanced.

On the other hand, in order to delay the fuel injection timing from the spark advanced state in accordance with reduction of the rotational number of the engine or the like, the opening degree of the electromagnetic valve 3 is controlled to be large (in the opening direction), so that the fuel in the pump chamber A flows into the low-pressure chamber 41L through the passage 110, the electromagnetic valve 3 and the passage 120, and the pressure of the low-pressure chamber 41L rises up. Therefore, the pressure balance at the right and left sides of the valve 150*b* of the servo valve 150 is collapsed as represented by the equation (2), and the valve plug 150*b* is shifted to the left side of FIG. 3 (to the spark delay side).

When the valve plug 5*b* is shifted to the left side of FIG. 3 and the passages 151 and 152 intercommunicate with each other through the groove 155, the fuel in the high-pressure chamber 41H flows into the low-pressure chamber 41L, and the pressure of the low-pressure chamber 41L rises up. Therefore, the timer piston 4 is shifted to the left side of FIG. 3 by the pump driving reaction force and the spring force of the external side spring 6*b*, so that the roller holder (not shown) is reversely rotated through the link pin (not shown) and the fuel injection timing is delayed.

In the embodiment shown in FIG. 3, if the pump driving reaction force acts when the fuel injection timing is controlled in the spark advance direction (the timer piston 4 is shifted to the right side of FIG. 3), the reaction force acts to push back the timer piston 4 to the left side of FIG. 3. In this case, if the passages 11 and 153 are set to intercommunicate with each other through the groove 155 when the above reaction force acts, the fuel in the high-pressure chamber 41H counterflows into the pump chamber A through these passages. However, according to this embodiment, the check valve 154 is provided in the passage 153, and thus the counterflow of the fuel can be surely prevented by the check valve 154.

As described above, according to the servo valve type timer of the present invention, by controlling the pressure of the low-pressure chamber, the movement of the servo valve is controlled and thus the movement of the timer piston is controlled, so that the pressure around the pressure receiving face of the servo valve which faces the low-pressure chamber can be greatly varied. Therefore, the controllable range of the fuel injection timing can be broadened.

What is claimed is:

1. A valve of the type used to control fuel injection timing on the basis of a pressure differential between a high-pressure chamber and a low-pressure chamber, said valve comprising:

a housing having a bore;

a piston slidably located within said bore and defining a high-pressure chamber and a low-pressure chamber having a low-pressure port, said piston including a fluid passage for receiving inlet fluid at a predetermined fluid pressure, said displacement of said piston within said bore being responsive to the fluid pressure of said high-pressure chamber with respect to the fluid pressure of said low-pressure chamber;

a servo valve located within said piston for selectively diverting at least a portion of said inlet fluid to said high-pressure chamber in response to said fluid pressure of said low-pressure chamber; and means for controlling the fluid pressure within said low-pressure chamber said pressure control means including an orifice located in said low-pressure port and an electromagnetic fluid valve for controlling the flow of fluid into said low-pressure chamber, said electromagnetic fluid valve being positioned along a fluid passage connecting said low-pressure chamber with a pump chamber so that selective operation of said electromagnetic fluid valve controls fluid flow along said passage and thereby controls the fluid pressure of said low-pressure chamber.

2. The valve according to claim 1, wherein said servo valve includes a check valve for preventing the flow of fluid from said high-pressure chamber to said pump chamber.

3. The valve according to claim 1, wherein said servo valve includes a first passage through which fluid is selectively allowed to pass from said high-pressure chamber to said low-pressure chamber and a second passage through which inlet fluid is selectively allowed to pass into said high pressure chamber.

4. A valve of the type used to control fuel injection timing on the basis of a pressure differential between a high-pressure chamber and a low-pressure chamber, said valve comprising:

a housing having a bore;

a piston slidably located within said bore and defining a high-pressure chamber and a low-pressure chamber, said piston including a fluid passage for receiving inlet fluid at a predetermined fluid pressure, said displacement of said piston within said bore being responsive to the fluid pressure of said high-pressure chamber with respect to the fluid pressure of said low-pressure chamber;

a servo valve located within said piston for selectively diverting at least a portion of said inlet fluid to said high-pressure chamber in response to said fluid pressure of said low-pressure chamber; and means for controlling the fluid pressure within said low-pressure chamber said pressure control means including an electromagnetic fluid valve for controlling the flow of fluid into said low-pressure chamber, said electromagnetic valve is in fluid communication between said low-pressure chamber and a low-pressure port.

* * * * *